US005188180A

United States Patent [19]

Jennings

[11] Patent Number: 5,188,180

[45] Date of Patent: Feb. 23, 1993

[54] HYDRAULIC CIRCUIT FOR A WELL TOOL

[75] Inventor: Charles E. Jennings, Houston, Tex.

[73] Assignee: ABB Vetco Gray Inc., Houston, Tex.

[21] Appl. No.: 744,146

[22] Filed: Aug. 13, 1991

[51] Int. Cl.[5] ..... E21B 23/04

[52] U.S. Cl. ..... 166/338; 166/348; 166/372

[58] Field of Search ..... 166/338, 341, 343, 344, 166/348, 360, 368, 374, 375

[56] References Cited

U.S. PATENT DOCUMENTS

| | | | |
|---|---|---|---|
| 3,993,100 | 11/1976 | Pollard et al. | 166/338 X |
| 4,903,776 | 2/1990 | Nobileau et al. . | |
| 4,928,769 | 5/1990 | Milberger . | |
| 4,969,516 | 11/1990 | Henderson et al. . | |
| 5,029,647 | 7/1991 | Milberger et al. | 166/368 X |
| 5,044,442 | 9/1991 | Nobileau | 166/348 X |

*Primary Examiner*—William P. Neuder
*Attorney, Agent, or Firm*—James E. Bradley

[57] ABSTRACT

A running tool for a subsea well utilizes a hydraulic circuit that will amplify tension pulled on drill pipe to perform various functions. The running tool has a pump cylinder which will pump hydraulic fluid once the running tool is latched into the wall assembly. The fluid is pumped out by upward movement of the drill pipe to a first function cylinder. The first function cylinder applies pressure to the well assembly to perform the first function. The operator pulls until a selected tension has been reached. Then the operator will slack off. At that moment, a pilot controlled control valve will shift to a second mode. In the second mode, continued pulling of tension on the drill pipe will supply hydraulic fluid to a second function cylinder.

15 Claims, 6 Drawing Sheets

HYDRAULIC CIRCUIT FOR A WELL TOOL

BACKGROUND OF THE INVENTION

1. Field of the Invention

This invention relates in general to well tools that are lowered on a string of drill pipe and which are actuated by hydraulic force due to axial movement of the drill pipe once they latch into a well assembly.

2. Description of the Prior Art

In oil well drilling, many operations must be performed remotely. For example, running tools are utilized to position equipment in subsea wells. The water can be several thousand feet deep.

In U.S. Pat. application Ser. No. 515,858, filed Apr. 27, 1990, Lionel J. Milberger, et al, an inner or high pressure wellhead housing is pressed into an outer or low pressure wellhead housing. The inner and outer wellhead housings have a two-point socket for resisting bending forces due to wave and current action The force to preload this connection could require up to one million pounds compression. A tool is needed that will accomplish this preloading remotely.

SUMMARY OF THE INVENTION

In this invention, a tool is provided that is lowered on conduit such as drill pipe. The tool has an internal sealed hydraulic circuit. The tool has hydraulic cylinders that perform at least two functions.

After the tool latches releasably into the well, axial movement of the drill pipe causes a plurality of pump cylinders to begin supplying hydraulic fluid. The fluid flows through a control valve to the first function cylinders. The first function cylinders then perform their task.

After the first task is performed and once the hydraulic pressure reaches a selected level, a pressure actuated valve will cause some of the fluid from the pump cylinders to flow to an accumulator. This results in the accumulator charging to the selected pressure level. A check valve prevents the fluid flowing to the accumulator from flowing back into the pump cylinders.

The operator will slack off tension in the drill pipe after holding the selected pressure for a selected duration. A pilot means associated with the control valve compares the fluid pressure at the pump cylinders to the fluid pressure in the accumulator. Consequently, the pilot means will detect a difference in pressure between that of the accumulator and the pressure of the pump cylinder once the operator slacks off after reaching the selected pressure.

The pilot means then will shift the control valve to a second mode. In the second mode, the output line of the pump cylinders leads to the second function cylinders. Continued upward axial movement of the drill pipe then supplies hydraulic fluid under pressure to the second cylinders. The second cylinders will perform their function as the first cylinders are retracting.

In the preferred embodiment, the hydraulic circuit is utilized with a tool for installing an inner wellhead housing within an outer wellhead housing, wherein the housings are provided with two-point sockets. The tool has a sleeve which latches to the outer wellhead housing. The first function cylinders will push downward on the inner wellhead housing, reacting against the sleeve to insert the inner wellhead housing into place. The second function cylinders will release the sleeve from the outer wellhead housing as the first cylinders are retracting.

DETAILED DESCRIPTION OF THE INVENTION

Figure 1A:
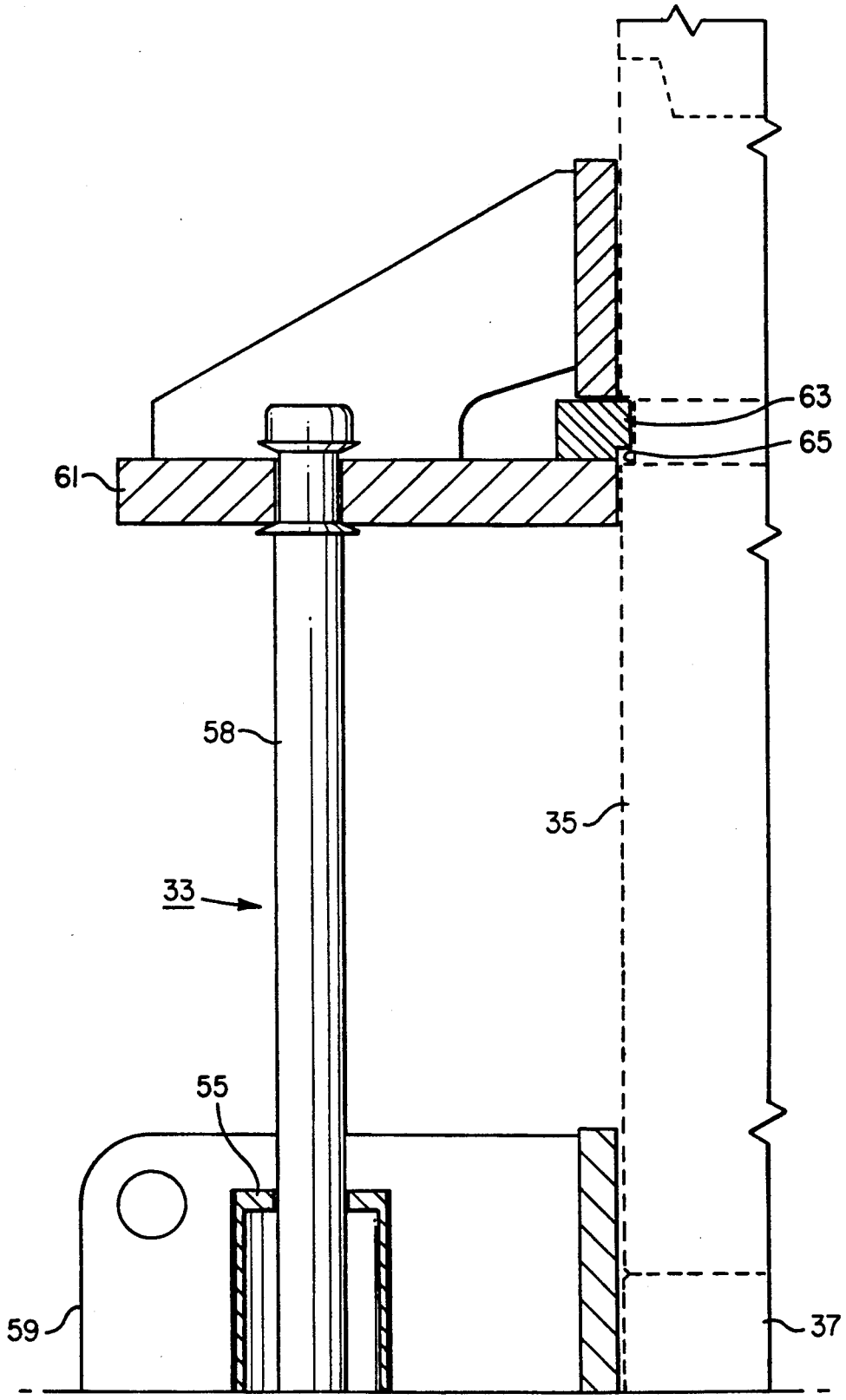
FIG. 1A, 1B and 1C comprise a quarter sectional view of a portion of a subsea wellhead assembly and a running tool constructed in accordance with this invention, with the running tool shown in a mode at the conclusion of the installation of the inner wellhead housing into the outer wellhead housing but before release of the running tool from the outer wellhead housing.
Figure 1B:
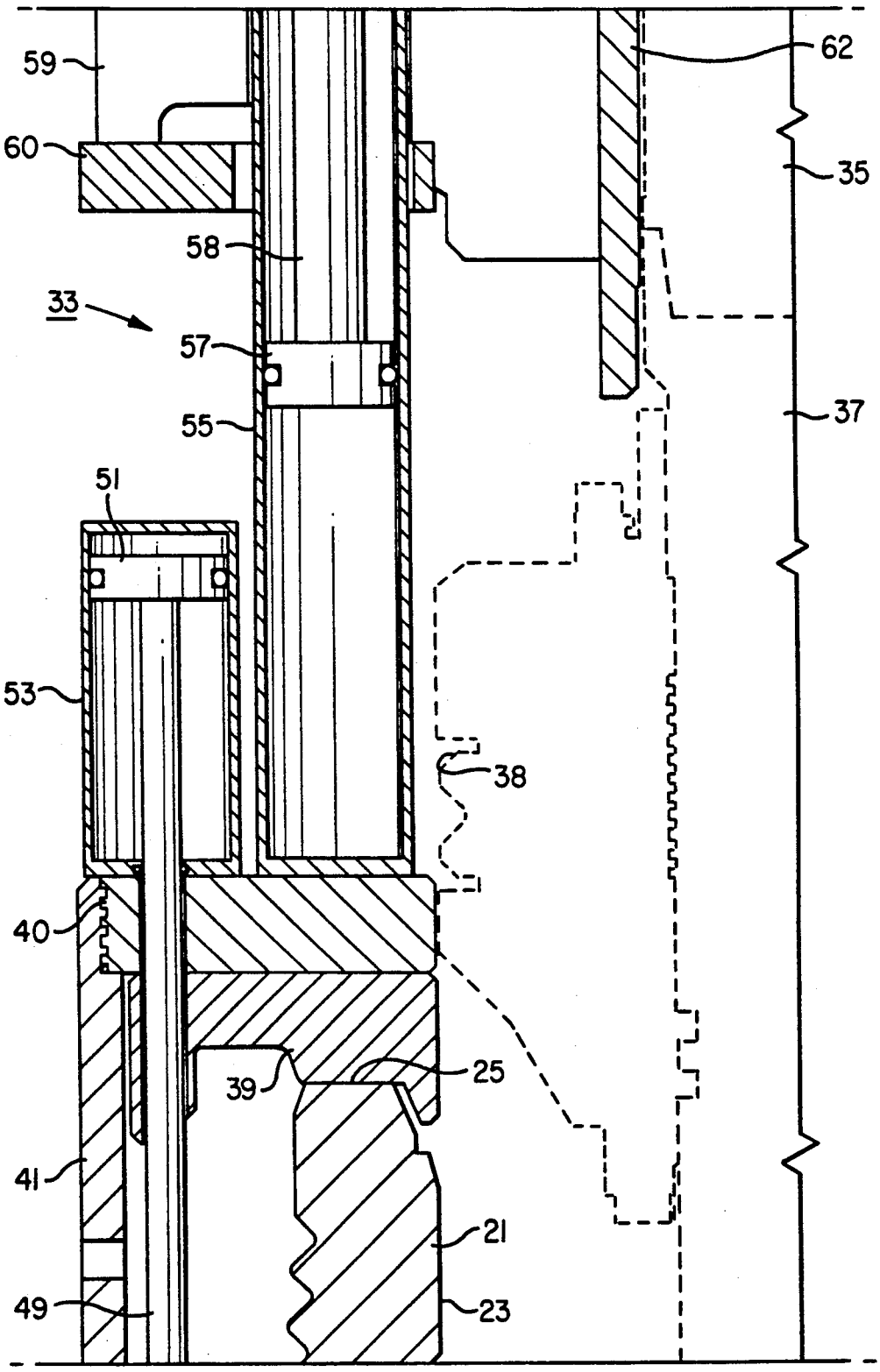
Figure 1C:
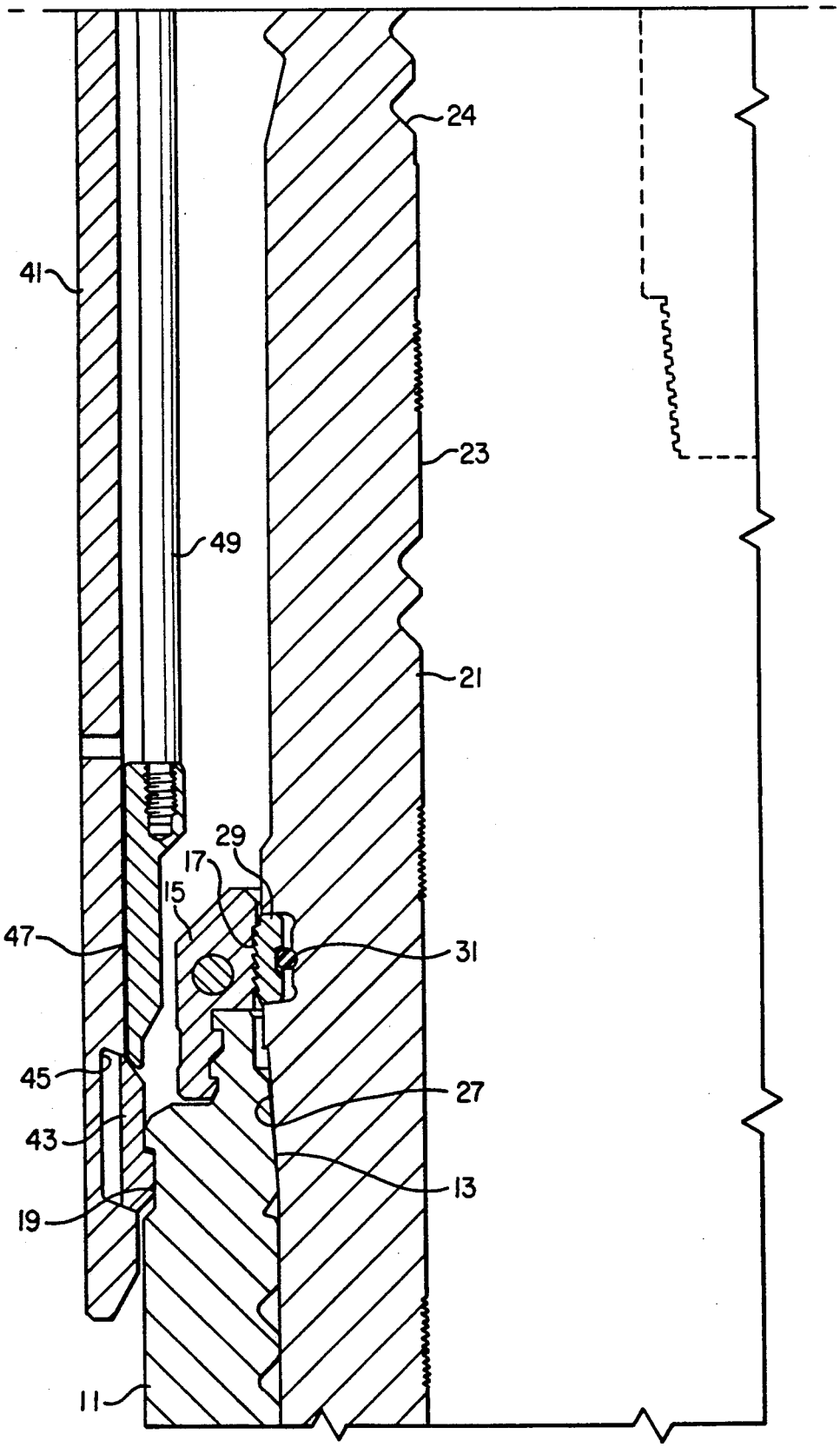

Referring to FIG. 1C, outer or low pressure wellhead housing 11 is a large tubular member that will be located at the subsea floor. Large diameter conductor pipe (not shown) secures to the lower end of outer wellhead housing 11 and extends into the well for a depth of typically 500 to 1,000 feet. Outer wellhead housing 11 has an axial bore 13. A locking member 15 mounts to the upper end of outer wellhead housing 11. Locking member 15 has a plurality of teeth 17 on its inner diameter. An external groove 19 extends circumferentially around the exterior of outer wellhead housing 11 near its upper end.

Inner or high pressure wellhead housing 21 inserts into the outer wellhead housing 11. The lower end of inner wellhead housing 21 will be secured to a first string of casing (not shown) that typically extends into the well about 2000 feet. Inner wellhead housing 21 has an axial bore 23 and an upper rim 25. Inner wellhead housing 21 has a plurality of interior grooves 24 located in bore 23. Inner wellhead housing 21 has two axially spaced apart conical wedge surfaces 27 (only one shown) on its exterior. These mate with similar conical wedge surfaces formed in bore 13 of outer wellhead housing 11.

A locking ring 29 secures to the exterior of inner wellhead housing 21. Locking ring 29 is biased outward by an O-ring 31. Locking ring 29 has teeth on its exterior that will ratchet into and engage the teeth 17 of locking member 15. A running tool 33 (FIG. 1A) pushes the inner wellhead housing 21 into the outer wellhead housing 11 with a large compressive force. The locking ring 29 will ratchet into and secure to the locking member 15 to retain the inner wellhead housing 21 within the outer wellhead housing 11.

Referring to FIG. 1A, running tool 33 is utilized for installing the inner wellhead housing 21 within the outer wellhead housing 11. Running tool 33 includes a tubular, axially extending mandrel 35. Mandrel 35 connects on its upper end to conduit, such as a string of drill pipe that extends to the drilling vessel or platform. As shown by the dotted lines in FIG. 1A, a connecting assembly 37 mounts to mandrel 35.

Connecting assembly 37 is of a conventional type. It has dogs 38 that will extend into engagement with the grooves 24 (FIG. 1C). Connecting assembly 37 in the embodiment shown operates upon rotation. Rotation of the drill pipe and the mandrel 35 relative to the inner wellhead housing 21 will cause the dogs 38 to extend and to retract, depending upon the direction of rotation. During lowering of the inner wellhead housing 21 into the sea and into the outer wellhead housing 11, the dogs 38 will be in engagement with the grooves 24.

Referring still to FIG. 1B running tool 33 has a support plate 39 that is adapted to contact the rim 25 of inner wellhead housing 21. Support plate 39 is an annular member that is used to transfer a downward force on the inner wellhead housing 21.

An annular flange 40 locates above support plate 39. Flange 40 is axially moveable relative to support plate 39. A sleeve 41 secures by threads to the outer diameter of flange 40. Sleeve 41 is a large tubular member that extends over the exterior of the outer wellhead housing 11, shown in FIG. 1C.

A lock ring 43 is carried on the inner diameter of the sleeve 41 near the lower end, as shown in FIG. 1C. Lock ring 43 is a split ring that will move between an inner position, as shown in FIG. 1C, and an outer position, shown by the dotted lines in FIG. 2B. In the outer position illustrated by the dotted lines in FIG. 2B, lock ring 43 moves outward into an annular recess 45 provided in sleeve 41. Lock ring 43 is naturally biased toward the inner position shown in FIG. 1C. In the inner position, lock ring 43 engages groove 19 of outer wellhead housing 11. This engagement releasably secures the running tool 33 to the outer wellhead housing 11.

Figure 2A:
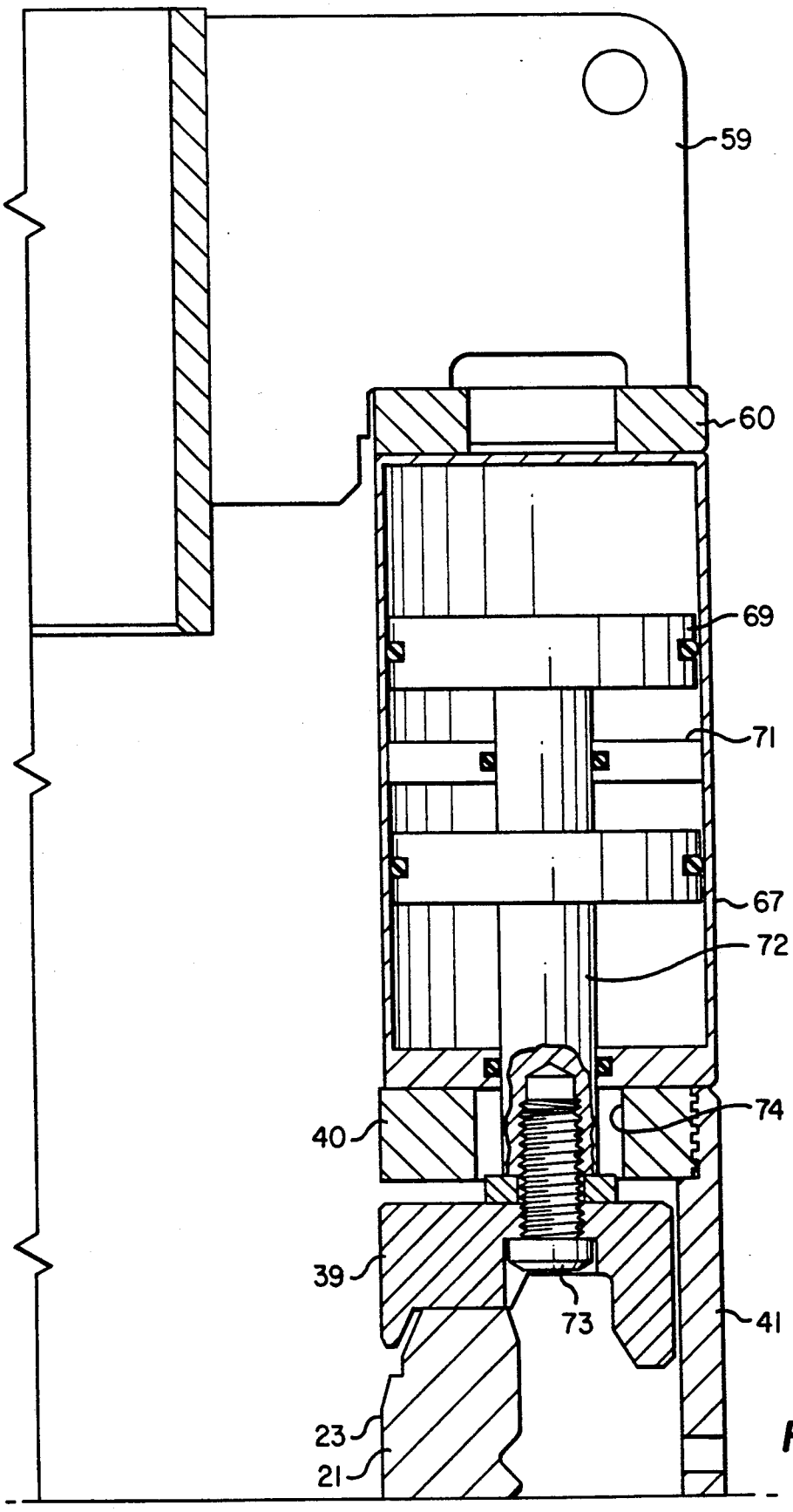
FIGS. 2A and 2B are enlarged, sectional views of portions of the running tool of FIGS. 1A-1C, shown on a different section from that shown in FIGS. 1A-1C.
Figure 2B:
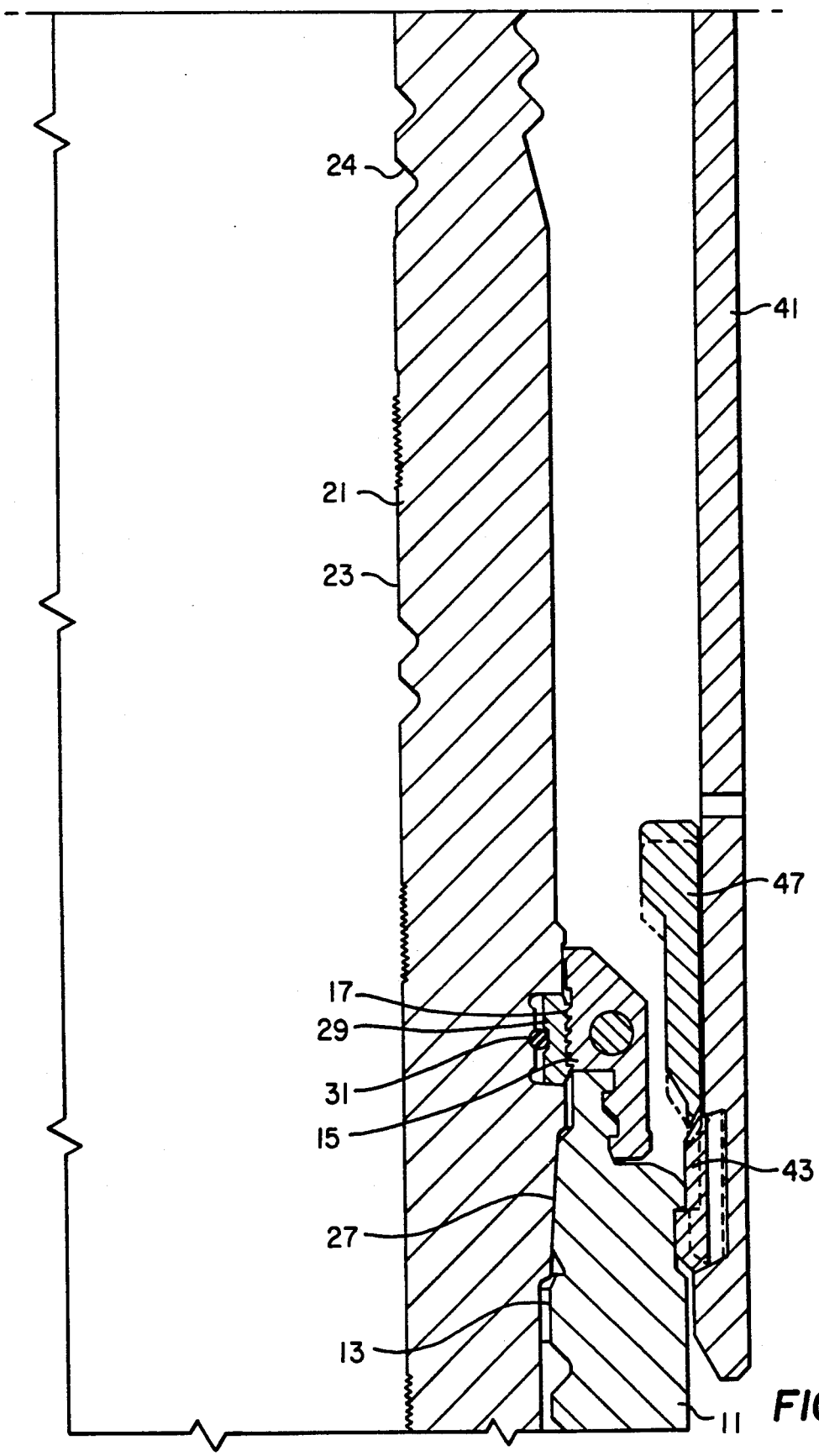

A cam 47 will push the lock ring 43 to the outer released position shown in FIG. 2B by the dotted lines. Cam 47 is a sleeve that mounts on the inner diameter of sleeve 41. Cam 47 will move axially between an upper position shown in FIG. 1C and a lower position shown by the dotted lines in FIG. 2B. In the lower position, cam 47 pushes the lock ring 43 to the released position.

A plurality of rods 49 (only one shown) extend axially upward from cam 47. As shown in FIG. 1B rods 49 extend through holes in support plate 39 and in flange 40 and connect to a release cylinder piston 51. Rods 49 move independently of support plate 39 and flange 40. Each release piston 51 moves axially within a release cylinder 53. Release cylinders 53 are spaced circumferentially around and secured to the flange 40. When supplied with hydraulic fluid pressure above release piston 51, the rods 49 move downward to move the cam 47 (FIG. 1C) downward to push the lock ring 43 to the released position.

Referring to FIGS. 1A and 1B, a plurality of pump cylinders 55 mount to the upper side of flange 40. Pump cylinders 55 (only one shown) mount to flange 40 and are spaced circumferentially around the flange 40. Each pump cylinder 55 has a pump piston 57. A rod 58 extends upward from piston 57. As shown in FIGS. 1A–1B, four vertically oriented gussets 59 (only one shown) are spaced around mandrel 35. Gussets 59 are spaced above flange 40 and welded to an annular plate 60 and a lower sleeve 62. Pump cylinders 55 extend between the gussets 59.

Rods 58 secure to a moveable plate 61 that is spaced above body portion 59. Moveable plate 61 is axially moveable relative to body portion 59. A retainer ring 63 secures moveable plate 61 to mandrel 35. Retainer ring 63 locates within a groove 65 in mandrel 35, which in turn in connected to a string of drill pipe. When sleeve 41 is fastened to outer wellhead housing 11, as shown in FIG. 1C, upward movement of mandrel 35 by pulling upward on the drill pipe will move rods 58 upward. This movement causes pistons 57 to push hydraulic fluid from pump cylinder 55. In one mode, the fluid displaced from pump cylinder 55 by upward movement of pump pistons 57 will supply hydraulic pressure to the release cylinder 53.

In another mode, the hydraulic pressure from movement of pump piston 57 will supply hydraulic pressure to actuating cylinders 67, shown in FIG. 2A. Actuating cylinders 67 (only one shown) comprise a plurality of cylinders sandwiched and bolted between flange 40 and annular plate 60. The bolts are not shown. Cylinders 67 also extend circumferentially around flange 40, with the release cylinders 53 and pump cylinders 55 (FIG. 1B) disposed between them.

Actuating cylinders 67 each have a pair of pistons 69. Pistons 69 are separated by a partition 71 within each actuating cylinder 67. This results in two separate chambers for each actuating cylinder 67. The single piston rod 72 for the two pistons 69 extends through a hole 74 in flange 40. The rod 72 is secured by a fastener 73 to the support plate 39. Hydraulic fluid pressure supplied by pump cylinder 55 (FIG. 1B) to the upper sides of the pistons 69 will push downward on the support plate 39 to push the inner wellhead housing 21 into the outer wellhead housing 11 (FIG. 1C). The reactive force is transmitted through gussets 59, annular plate 60, actuating cylinder 67 and sleeve 41 to the outer wellhead housing 11 (FIG. 2B).

Figure 3:
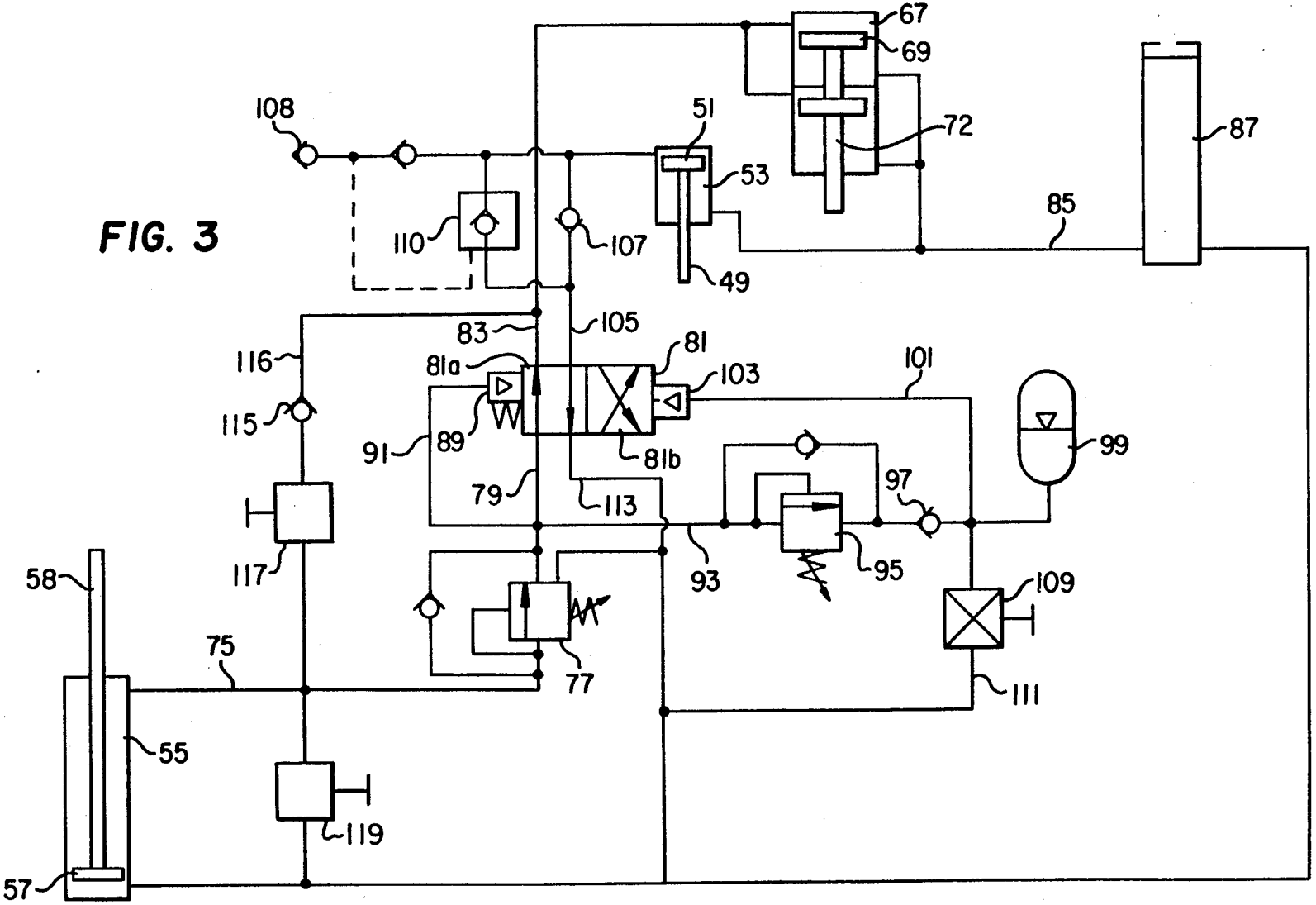
FIG. 3 is a schematic of a hydraulic circuit incorporated with the running tool of FIGS. 1A-1C.

Referring to FIG. 3, output line 75 leads from the pump cylinders 55 to a minimum pressure valve 77. Minimum pressure valve 77 will prevent the passage of any hydraulic fluid through line 75 until a minimum pressure has been reached. This pressure for example may be around 250 PSI. Minimum pressure valve 77 prevents the running tool 33 from actuating due to its own weight while it is being lowered into the sea.

Line 79 from minimum pressure valve 77 leads to a control valve 81. Control valve 81 has two positions **81*a* and 81*b*, and is shown in the position 81*a*. When shifted, one port of position 81*b* will be in communication with line 79**.

Line 83 leads from control valve 81 to actuating cylinder 67. The return from actuating cylinder 67 connects to a return line 85 which leads back to the return side of the pump cylinders 55. Because of the rods 72 extending out one end of actuating cylinders 67, more fluid will be going into the cylinders 67 than is pushed out by the pistons 69. Accumulator 87 makes up the difference in fluid. Accumulator 87 is connected to return line 85 and has one side exposed to subsea pressure.

Control valve 81 has a pilot means for causing valve 81 to shift from the position **81*a* shown in FIG. 3 to the position 81*b* once a selected pressure has been reached, and when the pressure in line 79 is subsequently decreased. The pilot means includes a pilot 89 which is spring biased. Pilot 89 has a line 91 that connects to the line 79. Consequently, pilot 89 will be exposed to the output pressure of pump cylinder 55 once the minimum pressure valve 77** is shifted to the open position.

Line 79 leading to control valve 81 also connects to a line 93. Line 93 leads through a pressure valve 95. Pressure valve 95 is set at a fairly high pressure, for example 2700 PSI. It will not allow fluid to pass through line 93 unless the selected pressure has been reached. Once reached, the fluid will flow from line 93 through a check valve 97 and into an accumulator 99. The fluid pressure will charge the accumulator 99 to the selected pressure. Check valve 97 prevents any flow from accumulator 99 back to line 79. Consequently, the pressure in accumulator 99 will not drop even if the pressure in line 79 drops.

The pressure in accumulator 99 is communicated by a line 101 to a pilot 103. Pilot 103 connects to control valve 81 for controlling control valve 81 along with pilot 89. Pilot 103 will not shift control valve 81 to the position 81*b*, until it senses a pressure that is greater than the pressure at pilot 89 plus the amount of spring force due to the spring of pilot 89. For example, the spring force might require an additional 150 PSI at pilot 103 over pilot 89 in order 24 to cause Control valve 81 to shift to position 81*b*.

Once accumulator 99 is charged to the selected pressure, this pressure cannot bleed off back into the line 79 because of check valve 97. Consequently, if the output pressure from pump cylinder 55 decreases, then the pressure at pilot 103 will exceed the pressure at pilot 89. Slacking tension off in the drill pipe after accumulator 99 is charged will reduce the pressure line 79 and cause the control valve 81 to shift to position 81*b*.

The hydraulic circuit also includes a line 105 that leads to a check valve 107 from the output of control valve 81. Line 105 leads to a remote operated vehicle (ROV) input 108. Input 108 may be utilized to apply pressure to the release cylinder 53 in the event of failure of the hydraulic circuitry. Check valve 110 is pilot operated and normally open. Check valve 110 will close to flow in both directions if it senses pressure downstream of input 108, which occurs when the ROV applies hydraulic pressure. The running tool 33 (FIG. 1A) also preferably has a manual release system that is utilized with an ROV in the event of hydraulic failure. The manual release system may be of various types and is not shown.

Additionally, the system includes a bleed off valve 109 which is used to bleed pressure from accumulator 99 into a line 111 once the running tool 33 (FIG. 1) is retrieved to the surface. Line 111 leads to the return of pump cylinder 55. Bleed off valve 109 will be utilized at the surface to discharge accumulator 99 and allow the running tool 33 to be reset. Also, the circuitry includes a return line 113 that extends from the sequencing valve 81 back to the return line 85. Line 113 allows piston 69 to vent when control valve 81 shifts from ports 81*a* to 81*b*. Line 113 is also used when retracting pistons 69 and 51. Line 113 forms an open sloop with line 85, which allows piston 51 to be pushed down during a manual release mode without being hydraulically blocked.

A check valve 116 is connected into a line 116 that extends from cylinder 55 on the lower side of pump piston 57 to line 83. Check valve 116 prevents flow through line 116 on the upstroke of pump piston 57. Check valve 116 allows flow back into the cylinder 55 on the upper side of pump piston 57 during the downstroke. This replenishes the fluid of pump cylinder 55 while relaxing the load to switch control valve 81 from ports 81*a* to ports 81*b*. A manual valve 117 allows the line 116 to be closed to isolate check valve 115 if desired.

A manual valve 119 connects upper and lower points of the cylinder 55 to be used for stroke adjustment.

In operation, the outer wellhead housing 11 will be previously installed at the subsea floor. Running tool 33 will be secured to the inner wellhead housing 21 by the connecting assembly 37 engaging grooves 24 (FIG. 1C). Initially, pump piston 57 (FIG. 1B) will be in a lowermost position.

The entire assembly will be lowered into the sea, with a string of casing connected to the lower end of the inner wellhead housing 21. The inner wellhead housing 21 will land in the outer wellhead housing 11. Lock ring 43 (FIG. 1C) will snap into groove 19 and lock the sleeve 41 to outer wellhead housing 11.

The operator will then pull some tension to make sure that the lock ring 43 is latched to the outer wellhead housing 11. Then, the operator will rotate the drill pipe. This retracts the dogs 38 (FIG. 1B) from the grooves 24. The operator then picks up the drill pipe. As he begins picking up the drill pipe, the pump pistons 57 (FIG. 1) will begin moving upward. Once a minimum pressure of about 250 PSI has been reached, the fluid will flow through the valve 77 (FIG. 3) into the sequencing valve 81.

The fluid flows out the line 83 into the actuating cylinders 67, shown also in FIG. 2A. The pressure will act on the pistons 69. This pressure causes the pistons 69 to push downward on the inner wellhead housing 21, causing it to move downward relative to the outer wellhead housing 11. The locking ring 29 (FIG. 1C) will ratchet into and latch into the locking member 15. In the preferred embodiment, the hydraulic circuit multiplies the tension pulled on the drill pipe by 13.5 for the compression applied to the inner wellhead housing 21.

The operator will pull until he applies tension of a selected amount, for example 70,000 pounds overpull. This overpull translates into about 2700 PSI pressure at the output line 79 (FIG. 3) of pump cylinder 55. The operator will then hold this tension for a certain time period. Once this selected pressure has been reached, the pressure valve 95 will allow the hydraulic fluid pressure from pump cylinder 55 to flow into the accumulator 99. The operator sustains the overpull at 70,000 pounds to make sure the accumulator 99 will charge to the selected pressure of 2700 PSI. At that point both pilots 89 and 103 will be experiencing 2700 PSI. Control valve 81 will not shift, however, until the pressure at pilot 103 exceeds the pressure at pilot 89 by an amount equal to the force of the spring associated with pilot 89.

The operator will then slack off on the drill pipe. The pressure at pilot 89 will drop rapidly because of downward movement of the pump cylinder piston 57. The pressure at accumulator 99, however will not drop because of check valve 97. Consequently, the pilot 103 will shift the control valve 81 to the position 81*b*. This shifting cannot occur until the selected pressure has been reached. As a result, prior to reaching that pressure, if wave action caused the pressure at the pump cylinder 55 to go up and down, the control valve 81 nevertheless would not shift.

Once shifted, the operator will again begin pulling tension on the drill pipe. Continued upward movement of pump piston 57 will supply hydraulic pressure now through line 105 and check valve 107 to the release cylinders 53. Referring also to FIG. 1B, pistons 51 will push the rods 49 (FIG. 1C) downward. The cam 47 will slide downward to push the lock ring 43 to the outer released position. Once this occurs, the running tool 33 may be retrieved. The operator continues to pull upward. The inner wellhead housing 21 will remain in place within the outer wellhead housing 11.

Running tool 33 may be subsequently reset at the surface before opening bleed off valve 109 by pushing down on pistons 57. This forces fluid through line 85 under pistons 51. Fluid above pistons 51 flows through line 105, position 81*b*, line 79 and line 75 into the top of cylinder 55. When pistons 51 are fully retracted, the operator opens bleed off valve 109. Control valve 81 will then shift back to position 81*a*. The operator continues to push down on pistons 57. Pistons 69 will retract, with fluid in cylinders 67 flowing through lines 83, position 81*a*, lines 79 and 75 into the top of cylinder 55.

The invention has significant advantages. With the appropriate number of hydraulic cylinders and sizes of hydraulic cylinders, the overpull on the drill string will result in a large compressive force. The hydraulics are completely internal, requiring no pumping of fluid from the surface. The hydraulic circuit will shift from one function to another function without any external signal needing to be applied electrically or hydraulically. The shift of function is achieved by pulling to a selected tension, then slacking off, then pulling again.

While the invention has been shown in only one of its forms, it should be apparent to those skilled in the art that it is not so limited, but is susceptible to various changes without departing from the scope of the invention.

I claim:

1. A tool adapted to be secured to conduit and lowered from a drilling rig into a well assembly, comprising in combination:

connecting means for releasably connecting the tool to the well assembly;

first cylinder means for performing a first function;

second cylinder means for performing a second function;

pump cylinder means for supplying hydraulic fluid pressure in response to axial movement of the conduit in a first direction after the tool is connected to the well assembly;

a control valve having an input line connected to the pump cylinder means, a first output line connected to the first cylinder means and a second output line connected to the second cylinder means, the control valve having a first position connecting the input line with the first output line and a second position connecting the input line to the second output line;

an accumulator connected to the input line;

pressure valve means connected between the input line and the accumulator for allowing hydraulic fluid to flow into and be stored in the accumulator only when a selected pressure is reached;

check valve means located between the input line and the accumulator for preventing hydraulic fluid in the accumulator from flowing back into the input line, causing the accumulator pressure to exceed the input line pressure when the pump cylinder means and conduit are moved in a direction opposite to the first direction after the selected pressure has been reached; and pilot means having one line connected to the input line and one line connected to the accumulator, for retaining the control valve in the first position until the pressure in the accumulator exceeds the pressure in the input line by a selected amount, then for shifting the control valve to the second position, so that subsequent axial movement by the conduit moves the pump cylinder means and supplies hydraulic fluid to the second cylinder means for performing the second function.

2. The running tool according to claim 1 wherein the first direction is upward.

3. The running tool according to claim 1 wherein said subsequent axial movement of the conduit is also in the first direction.

4. A subsea running tool adapted to be secured to conduit and lowered from a drilling rig to a subsea wellhead assembly for performing a function, comprising in combination:

connecting means for releasably securing the running tool to the wellhead assembly;

pump cylinder means for supplying hydraulic fluid in response to axial movement of the conduit in a first direction after the running tool is secured to the wellhead assembly by the connecting means;

actuating cylinder means for receiving the hydraulic fluid from the pump cylinder means and for performing said function;

release cylinder means for receiving the hydraulic fluid from the pump cylinder means after the actuating cylinder means has completed said function, and for actuating the connecting means for releasing the running tool from the wellhead assembly;

a control valve having an input line connected to the pump cylinder means, a first output line connected to the actuating cylinder means and a second output line connected to the release cylinder means, the control valve having a first position connecting the input line with the first output line and a second position connecting the input line to the second output line;

an accumulator connected to the input line;

pressure valve means connected between the input line and the accumulator for allowing hydraulic fluid to flow into and be stored in the accumulator only when a selected pressure is reached;

check valve means located between the input line and the accumulator for preventing hydraulic fluid in the accumulator from flowing back into the input line, causing the accumulator pressure to exceed the input line pressure when the pump cylinder means and conduit are moved in a direction opposite to the first direction after the selected pressure has been reached; and pilot means having one line connected to the input line and one line connected to the accumulator, for retaining the control valve in the first position until the pressure in the accumulator exceeds the pressure in the input line by a selected amount, then for shifting the control valve to the second position, so that subsequent axial movement by the conduit moves the pump cylinder means again and supplies hydraulic fluid to the release cylinder means for releasing the connecting means.

5. The running tool according to claim 4 wherein the first direction is upward.

6. The running tool according to claim 4 wherein said subsequent axial movement of the conduit is also in the first direction.

7. The running tool according to claim 4 wherein the connecting means connects the running tool to a tubular member of the wellhead assembly, the tubular member having at least one circumferential groove, and wherein the connecting means comprises:

a sleeve;

a locking member mounted to the sleeve for radial movement between engaged and disengaged positions with the groove; and a retainer mounted to the sleeve for axial movement into contact with the locking member between a release position in which the locking member is in the disengaged position and a locking position in which the locking member is in the engaged position, the release cylinder means being connected to the retainer for moving the retainer between the release and locking positions.

8. The running tool according to claim 4 wherein the function comprises inserting an inner wellhead housing into an outer wellhead housing, and wherein the actuating cylinder means comprises:

an actuating cylinder mounted to the running tool and having one end adapted to contact the inner wellhead housing, so that axial movement of the actuating cylinder in one direction pushes downward on the inner wellhead housing relative to the outer wellhead housing.

9. A subsea running tool adapted to be secured to conduit and lowered from a drilling rig to a subsea outer wellhead housing for inserting an inner wellhead into the outer wellhead housing, comprising in combination:

means for releasably securing the inner wellhead housing to the running tool;

connecting means for releasably securing the running tool to the outer wellhead housing assembly as the inner wellhead housing enters the outer wellhead housing;

pump cylinder means mounted between the running tool and the conduit for supplying hydraulic fluid in response to upward movement of the conduit relative to the running tool after the running tool is secured to the outer wellhead housing by the connecting means;

actuating cylinder means for receiving the hydraulic fluid from the pump cylinder means and for forcing the inner wellhead housing downward relative to the outer wellhead housing as the conduit is moved upward and as tension is applied to the conduit;

release cylinder means for receiving the hydraulic fluid form the pump cylinder means after the actuating cylinder means has forced the inner wellhead housing downward until a selected hydraulic pressure due to tension in the conduit has been reached, and for actuating the connecting means for releasing the running tool from the wellhead assembly;

a control valve having an input line connected to the pump cylinder means, a first output line connected to the actuating cylinder means and a second output line connected to the release cylinder means, the control valve having a first position connecting the input line with the first output line and a second position connecting the input line to the second output line;

an accumulator connected to the input line;

pressure valve means connected between the input line and the accumulator for allowing hydraulic fluid to flow into and be stored in the accumulator only when the selected pressure is reached;

check valve means located between the input line and the accumulator for preventing hydraulic fluid in the accumulator from flowing back into the input line, causing the accumulator pressure to exceed the input line pressure when tension in the conduit is reduced after the selected pressure is reached; and pilot means having one line connected to the input line and one line connected to the accumulator, for retaining the control valve in the first position until the pressure in the accumulator exceeds the pressure in the input line by a selected amount, then for shifting the control valve to the second position, so that upward movement by the conduit again moves the pump cylinder means upward and supplies hydraulic fluid to the release cylinder means for releasing the connecting means.

10. The running tool according to claim 9 wherein the outer wellhead housing has at least one circumferential groove, and wherein the connecting means comprises:

a sleeve;

a locking member mounted to the sleeve for radial movement between engaged and disengaged positions with the groove; and a retainer mounted to the sleeve for axial movement into contact with the locking member between a release position in which the locking member is in the disengaged position and a locking position in which the locking member is in the engaged position, the release cylinder means being connected to the retainer for moving the retainer between the release and locking positions.

11. A method of performing first and second functions with a tool in a well assembly, comprising:

providing the tool with a first hydraulic cylinder for performing the first function;

providing the tool with a second cylinder for performing the second function;

providing the tool with a pump cylinder for supplying hydraulic fluid pressure in response to axial movement of the conduit in a first direction relative to portions of the tool;

providing the tool with a control valve connected between the pump cylinder and the first and second cylinders, the control valve having a first position communicating the pump cylinder with the first cylinder and a second position communicating the pump cylinder with the second cylinder;

biasing the control valve to the first position;

connecting the tool to a string of conduit and lowering the tool into the well assembly;

releasably connecting the tool to the well assembly;

moving the conduit axially in the first direction while the control valve is in the first position, causing the pump cylinder to supply fluid to the first cylinder to perform the first function; then once a selected hydraulic pressure at the first cylinder has been reached, moving the conduit in a second direction to cause hydraulic pressure at the first cylinder to decrease; then causing the decrease in pressure to shift the control valve to the second position; then moving the tool axially again to cause the pump cylinder to supply fluid to the second cylinder to perform the second function.

12. The method according to claim 11 wherein the axial movement while the control valve is in the second position is also in the first direction.

13. The method according to claim 12 wherein the first direction is upward.

14. The method according to claim 13 wherein the first function is to insert an inner wellhead housing into an outer wellhead housing.

15. The method according to claim 13 wherein the second function is to release the connection of the tool with the well assembly.

* * * * *

UNITED STATES PATENT AND TRADEMARK OFFICE

CERTIFICATE OF CORRECTION

PATENT NO. : 5,188,180

DATED : 02/23/93

INVENTOR(S) : Charles E. Jennings

It is certified that error appears in the above-identified patent and that said Letters Patent is hereby corrected as shown below:

At column 5, line 12, "24" is deleted;

At column 5, line 12, "Control" is changed to--control--;

At column 5, line 47, "sloop" is changed to--loop--;

At column 5, line 50, the first occurrence of "116" is changed to--115--;

At column 5, line 52, "116" is changed to--115--;

At column 5, line 54, "116" is changed to--115--.

Signed and Sealed this

Nineteenth Day of April, 1994

Bruce Lehman

*Attest:*

BRUCE LEHMAN

*Attesting Officer*

*Commissioner of Patents and Trademarks*